US006183217B1

(12) United States Patent
Elliott et al.

(10) Patent No.: US 6,183,217 B1
(45) Date of Patent: Feb. 6, 2001

(54) PILOT CONTROL VALVE FOR CONTROLLING A RECIPROCATING PUMP

(76) Inventors: Andrew C. Elliott; Ray A. Guccione, Sr., both of 716 Barataria Blvd., Marrero, LA (US) 70072

( * ) Notice: Under 35 U.S.C. 154(b), the term of this patent shall be extended for 0 days.

(21) Appl. No.: 09/330,470

(22) Filed: Jun. 11, 1999

(51) Int. Cl.[7] ..... F04B 17/00; F04B 9/08

(52) U.S. Cl. ..... 417/403; 417/390; 417/399

(58) Field of Search ..... 417/403, 390, 417/398, 399; 91/346, 461, 462, 308, 312, 304, 320

(56) References Cited

U.S. PATENT DOCUMENTS

| | | | | |
|---|---|---|---|---|
| 2,990,910 | * | 7/1961 | Kimmell | 95/209 |
| 3,374,713 | | 3/1968 | Broughton | 91/312 |
| 4,280,396 | * | 7/1981 | Zeuner et al. | 91/320 |
| 4,593,712 | * | 6/1986 | Quartana, III et al. | 91/308 |
| 4,776,773 | * | 10/1988 | Quartana, III et al. | 417/390 |
| 5,002,469 | | 3/1991 | Murata et al. | 417/403 |
| 5,468,127 | * | 11/1995 | Elliott et al. | 417/403 |

FOREIGN PATENT DOCUMENTS

| | | |
|---|---|---|
| 2168152 | 8/1996 | (CA) . |
| 196 03 434 A1 | 9/1996 | (DE) . |

* cited by examiner

*Primary Examiner*—Timothy S. Thorpe
*Assistant Examiner*—Michael K. Gray
(74) *Attorney, Agent, or Firm*—Jones, Walker, Waechter, Poitevent, Carrere & Denegre, L.L.P.

(57) ABSTRACT

A pilot control valve for controlling a reciprocating pump having a valve member shiftable within a valve body between a first or "downstroke" position and a second or "upstroke" position. When the valve member is in its first position, the valve member allows communication of control fluid to the lower surface of a piston to move the piston from a first position to a second position. As the piston reaches its second position, a vent in a rod attached to the piston allows control fluid acting on the valve member to depressurize. As such control fluid is depressurized, pressurized control fluid acts on the valve member to move the valve member from its first position to its second position. In its second position, the valve member blocks communication of the control fluid to the lower surface of the piston and allows communication of the control fluid to the upper surface of the piston causing the piston to return to its first position. As the piston returns to its first position, the vent in the piston rod allows the pressurized control fluid acting on the upper surface of the piston to act on the valve member to move the valve member back to its first position. In its first position, the valve member blocks communication of the control fluid to the upper surface of the piston and allows communication of the control fluid to the lower surface of the piston and the process is repeated. In this manner, the pilot control valve of the present invention achieves a consistent pumping rate for a reciprocating device coupled to the pilot control valve.

13 Claims, 3 Drawing Sheets

PILOT CONTROL VALVE FOR CONTROLLING A RECIPROCATING PUMP

BACKGROUND OF THE INVENTION

1. Field of the Invention

The present invention relates to a pilot control valve that achieves a continuous and consistent pumping rate for a reciprocating pump. More particularly, the pilot control valve of the present invention relates to a pilot control valve that controls the flow of control fluid to a piston, valve or the like to drive a reciprocating device such as a chemical or glycol injection pump. The pilot control valve of the present invention controls such flow through a pneumatic valve mechanism with the use of a reduced number of moving parts and a single movable valve member.

2. General Background

There are various devices known for controlling reciprocating pumps. Previous designs have used a separate pump and pilot assembly such as that illustrated in U.S. Pat. No. 2,990,910, issued to G. O. Kimmell and entitled "Apparatus And Method For Circulating Controlling Liquids and Gas-Liquid Systems". Other devices have used springs, nuts, bolts or other components for the backstroke of the piston, but these components often fatigue or fail under fluid pressure. These prior art devices were overcome by the pilot control valve inventions disclosed in U.S. Pat. No. 4,593,712, issued to Anthony J. Quartana, III, entitled "Pilot Control Valve" which issued on Jun. 10, 1986, and U.S. Pat. No. 4,776,773, issued to Anthony J. Quartana, III, entitled "Pilot Control Valve for Controlling the Pumping Rate of an Injection Pump" which issued on Oct. 11, 1988.

The pilot control valve disclosed in U.S. Pat. No. 4,593,712 includes a first or "leading" valve member and a second or "following" valve member coaxially positioned with respect to each other within a valve body to control the communication of control fluid to a piston included with an injection pump to initiate movement of the piston between its first or "downstroke" position and its second or "upstroke" position to drive the injection pump. In response to control fluid supplied to the valve body, the first valve member moves from its first or "downstroke" position to its second or "upstroke" position. The movement of the first valve member to its second position allows the control fluid to act on the second valve member causing it to move from its first or "downstroke" position to its second or "upstroke" position. When the second valve member reaches its second position, the piston of the injection pump returns to its first position. The return of the piston to its first position allows control fluid to cause the movement of the first valve member from its second position to its first position which then allows control fluid to cause the movement of the second valve member from its second position to its first position. As the second valve member returns to its first position, control fluid causes the piston and a rod attached to the piston to move upwardly toward its second position. As the piston moves upwardly, the end of the rod on the piston engages the first valve member and drives the first valve member upwardly to its second position and the process is repeated over and over. In this manner, the reciprocating pump achieves a consistent pumping rate.

The pilot control valve disclosed in U.S. Pat. No. 4,776,773 includes a first or "leading" valve member movable between a first and second position, but eliminates the use of a second or "following" valve member coaxially positioned with respect to the first valve member. Instead, a second or slide valve member is loosely mounted on the first valve member and is movable between a first or "downstroke" position, an intermediate position and a second or "upstroke" position. When in its first position, the second valve member allows communication of the control fluid to the piston included with the injection pump to initiate movement of the piston from its first or "downstroke" position to its second or "upstroke" position. As the piston moves upwardly, the end of the rod attached to the piston engages a surface of the first valve member to initiate its movement from its first to its second position. As the first valve member moves from its first to its second position, the first valve member moves the second valve member from its first position to its intermediate position and then to its second position. When in its intermediate position, the second valve member blocks the communication of control fluid to the piston and the piston is no longer driven upward. Finally, in its second position, the second valve member allows control fluid to return the piston to its first position and to move the first valve member from its second position back to its first position. This process is repeated over and over to achieve a consistent pumping rate.

Although the pilot control valves disclosed in U.S. Pat. No. 4,593,712 and U.S. Pat. No. 4,776,773 overcome the prior art devices, there is still a need in the industry for a pilot control valve that further reduces the number of moving parts in the valve mechanism to improve reliability and resistance to wear. The pilot control valve of the present invention improves the reliability of the prior art pilot control valves by providing a pilot control valve that controls the communication of control fluid to a piston included with a reciprocating device using pneumatic valve control rather than a mechanical control mechanism and requiring a reduced number of moving parts. The pilot control valve of the present invention eliminates the use of the second coaxial valve member disclosed in U.S. Pat. No. 4,593,712 and the second slide valve member disclosed in U.S. Pat. No. 4,776,773 and provides for the complete control of the upstroke and backstroke of the piston in a pneumatic manner with a single movable valve member.

SUMMARY OF THE INVENTION

The pilot control valve of the present invention relates to a pilot control valve that changes the directional flow of control fluid to a piston, valve or the like to drive a reciprocating device such as a chemical or glycol injection pump. The pilot control valve is positioned above the piston section included with the reciprocating device to provide linear, reciprocating force using compressible or non-compressible pressurized control fluid to drive the piston. The pilot control valve of the present invention controls the communication of the control fluid to the piston using pneumatic valve control using a reduced number of moving parts. The number of moving parts of the present invention is reduced over the prior art devices because only a single movable valve member is used.

More specifically, the pilot control valve of the present invention includes a valve member shiftable within a valve body between a first or "downstroke" position and a second or "upstroke" position. When in its first position, the valve member allows communication of control fluid supplied to the valve body to the lower surface of the piston to initiate movement of the piston from its first position to its second position. As the piston reaches its second position, a vent in a rod attached to the piston allows control fluid acting on the valve member retaining the valve member in its first position to depressurize and vent from the valve body. As such control fluid is depressurized and vented, pressurized control fluid acts on the valve member to initiate movement of the valve member from its first position to its second position. In its second position, the valve member precludes communication of control fluid to the lower surface of the piston and allows communication of control fluid to the upper surface of the piston causing the piston to return to its first position. As the piston returns to its first position, the vent in the piston rod allows the pressurized control fluid acting on the upper surface of the piston to act on the valve member to move the valve member back to its first position. In its first position, the valve member precludes communication of the control fluid to the upper surface of the piston and allows communication of the control fluid to the lower surface of the piston and the process is repeated over and over. The duration of each cycle can be varied by adjusting a back-pressure valve that varies the rate that the control fluid acting on the piston is depressurized and vented from the valve body during each cycle. In this manner, the pilot control valve of the present invention achieves a consistent pumping rate for the reciprocating device that uses only pneumatic valve control and a single movable valve member.

These and other features and advantages of the present invention will become apparent from the following detailed description, the accompanying drawings and the appended claims.

BRIEF DESCRIPTION OF THE DRAWINGS

For a further understanding of the features and advantages of the present invention, reference should be made to the following detailed description taken in conjunction with the accompanying drawings in which like parts are given like reference numerals and wherein.

DETAILED DESCRIPTION OF THE PREFERRED EMBODIMENT

Figure 1:
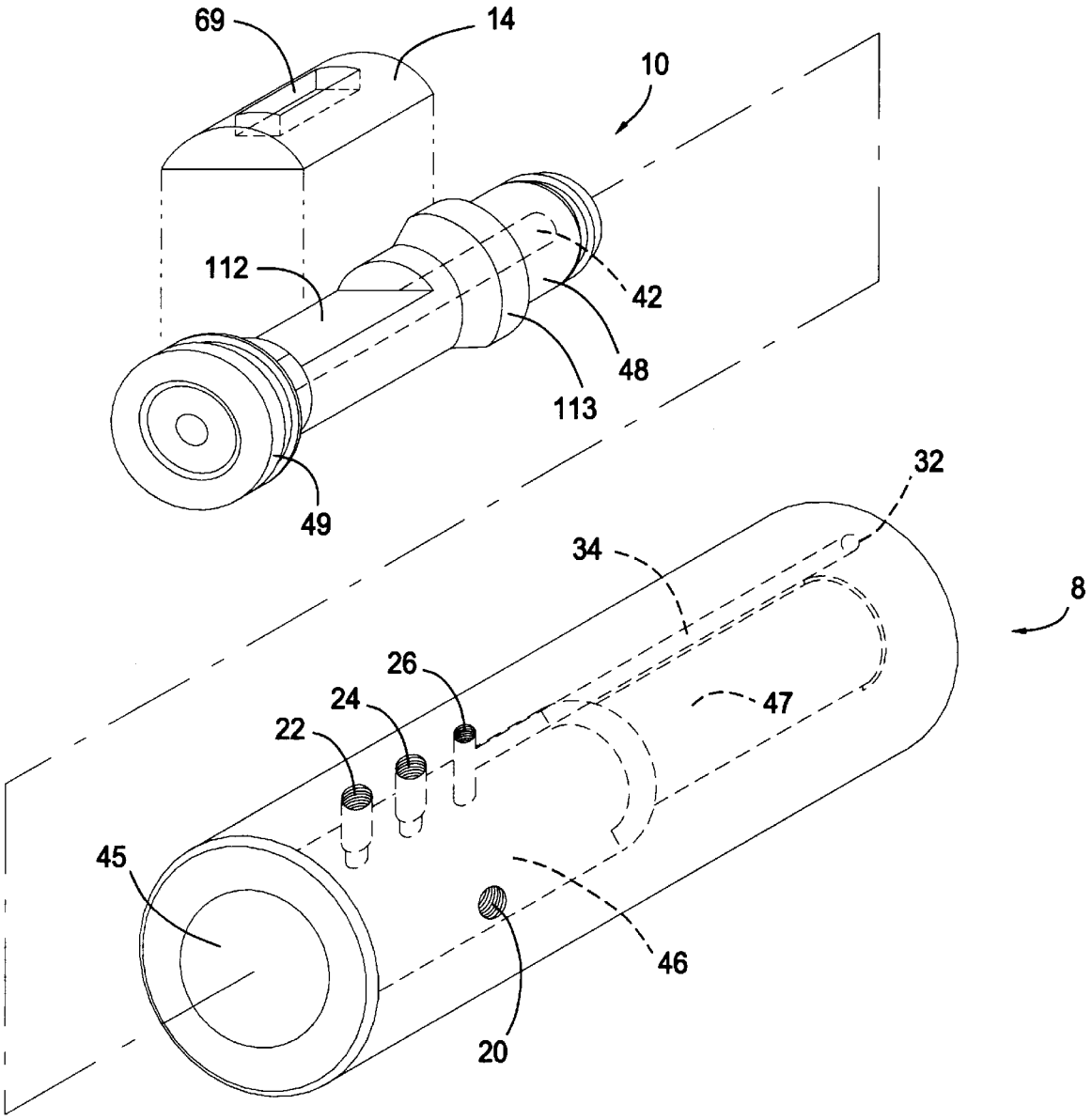
FIG. 1 is an exploded view of the pilot control valve of the present invention.
Figure 2:
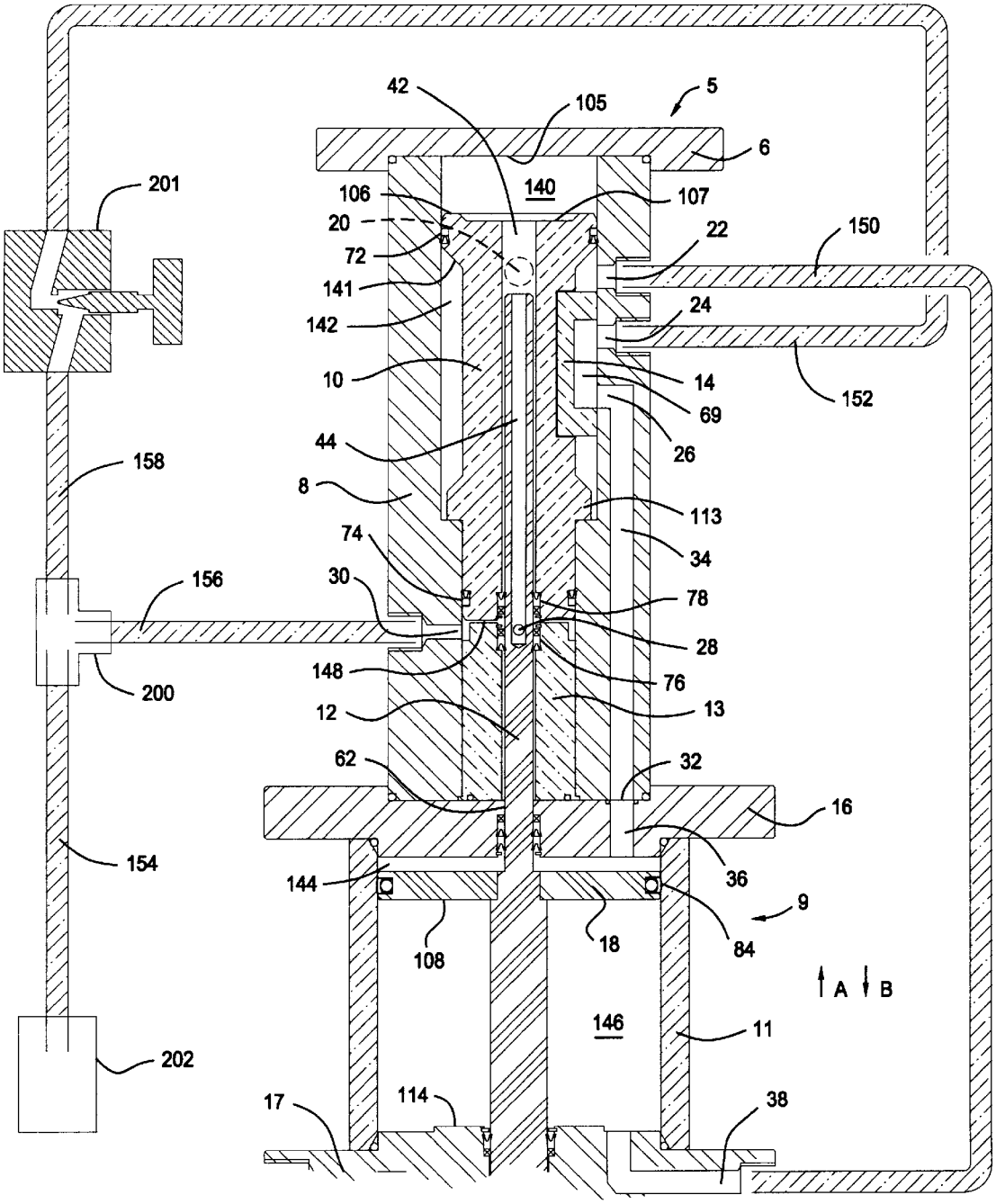
FIG. 2 is a vertical cross-sectional view of the present invention with the valve member of the present invention in its first position and the piston in its second position.
Figure 3:
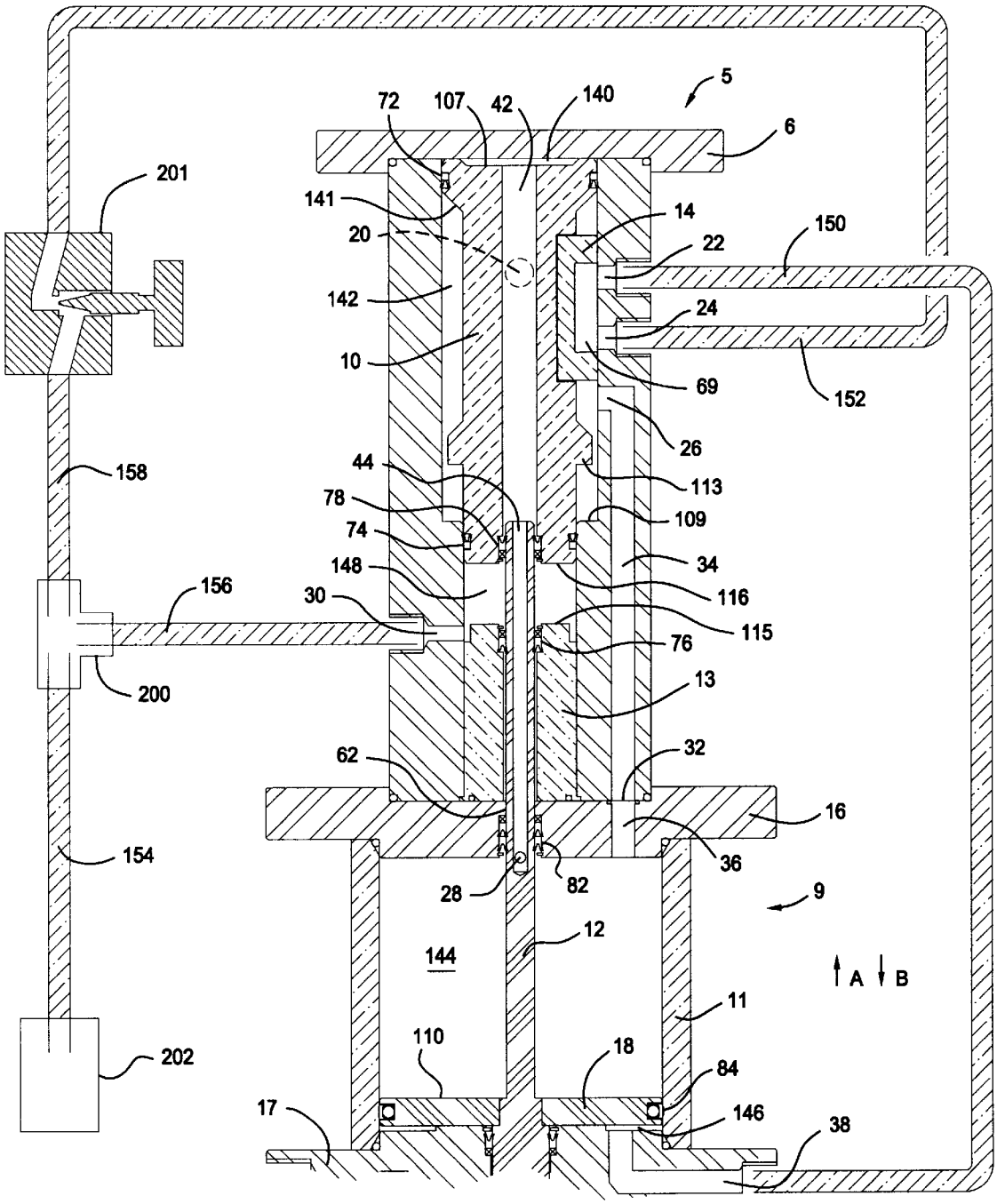
FIG. 3 is a vertical cross-sectional view of the present invention with the valve member of the present invention in its second position and the piston in its first position.

Referring now to the drawings, FIGS. 1–3 illustrate the preferred embodiment of the apparatus of the present invention. Reference numeral 5 is used to generally designate the pilot control valve of the present invention. As will be appreciated from FIGS. 1–3, pilot control valve 5 is designed to be coupled to a piston assembly 9 for a reciprocating device 17 such as a chemical or glycol injection pump. The pilot control valve 5 drives a piston 18 of the reciprocating device 17 using compressible or non-compressible pressurized control fluid. As further described below, a continuous and consistent pumping rate for the reciprocating device 17 is achieved using only pneumatic valve control and a single movable valve member.

As best shown in FIG. 1 but referring generally to FIGS. 1–3, the pilot control valve 5 includes a valve body 8 having a central bore 45 extending longitudinally through the valve body 8. The central bore 45 has two cylindrical portions with an upper cylindrical portion 46 having a slightly greater diameter than a lower cylindrical portion 47.

Intermediate the ends of the valve body 8 are provided ports 20, 22, 24, 26 and 30 in its wall for providing communication between the central bore 45 and, under selected operating conditions as further described below, either a source of supply of the control fluid, an upper piston chamber 144, a lower piston chamber 146, or the atmosphere to exhaust the control fluid. There is further provided in valve body 8 a port 32 disposed in the lower end portion of the valve body 8 and a longitudinal passageway 34 which extends parallel to the central bore 45 through a portion of the valve body 8. The longitudinal passageway 34 provides through ports 26 and 32, under selected operating conditions as described below, communication between the central bore 45 and the upper piston chamber 144 of the piston assembly 9.

As best shown in FIGS. 1A and 1B but referring generally to FIGS. 1–3, valve body 8 having central bore 45 slidably receives a valve member 10. Valve member 10 includes a cylindrical portion 48 to slidably engage the interior surface of the lower cylindrical portion 47 of valve body 8. Valve member 10 further includes an upper flared portion 49 to slidably engage the interior surface of the upper cylindrical portion 46 of the valve body 8. The flared portion 49 of the valve member 10 defines a first pressure receiving surface 141 and an annular chamber 142 between the inner surface of the valve body 8 and the outer surface of the valve member 10. Valve member 10 further includes a lower flared portion 113. Lower flared portion 113 has a smaller diameter than upper flared portion 49 and does not engage the interior surface of the upper cylindrical portion 46 of the valve body 8.

In a portion of the outer surface of valve member 10 is provided a slot 112 for receiving and integrally attaching a slide valve portion 14 to the valve member 10. Slide valve portion 14 defines an inner slot 69 selectively positioned to straddle and "cover" or "uncover" ports 22, 24 and 26 under selected circumstances as further described below. At the upper end of the outer surface of valve member 10 there is provided a seal 72 and at the lower end of the outer surface of valve member 10 there is provided a seal 74. Seals 72 and 74 each include an annular cup seal set in a groove formed in the outer surface of valve member 10 to engage the inner surface of valve body 8 and preclude the escape of control fluid from annular chamber 142 as further described below.

Valve member 10 is further provided with a central longitudinal bore 42 which extends throughout valve member 10. Valve member 10 is further provided with an annular cup seal 78 set in a groove formed in the inner surface of valve member 10 at its lower end to preclude the escape of control fluid from central longitudinal bore 42 as further described below.

FIGS. 2 and 3 show an assembled pilot control valve 5 of the present invention. Valve body 8 is provided with a top cap 6 sealably connected to the upper end of the valve body 8. Valve body 8 is further provided at its lower end with a sleeve member 13 having an upper sleeve surface 115. Sleeve member 13 sealingly engages the inner surface of the lower portion of the valve body 8 and defines a lower chamber 148 between the upper sleeve surface 115 and a lower end surface 116 of the valve member 10. Sleeve member 13 includes an annular cup seal 76 set in a groove in the inner surface of sleeve member 13 at its upper end to preclude the escape of control fluid from the lower chamber 148.

Valve body 8 is coupled to a top cover 16 of the piston assembly 9. A piston 18 having an upper surface 110 and a lower surface 108 is positioned within a piston housing 11 of the piston assembly 9 to define the upper piston chamber 144 and the lower piston chamber 146. Piston 18 is provided at its edge with a crown seal 84 to preclude communication of control fluid between upper piston chamber 144 and lower piston chamber 146. The piston 18 has a rod 12 rigidly attached which is aligned with the central longitudinal bore 42 of valve member 10. The rod 12 extends into central longitudinal bore 42 through a port 62 in top cover 16. The rod 12 further includes a central rod bore 44 having a transverse vent 28 at its lower end which provides communication between central rod bore 44 and, under selected operating conditions as further described below, either lower chamber 148 and port 30 or upper piston chamber 144.

As further described below, valve member 10 is slidably shiftable in central bore 45 between a first position and a second position by means of pressure applied by control fluid supplied to valve body 8 through port 20. The movement of valve member 10 between a first position and a second position further controls the communication of control fluid to either the upper surface 110 or the lower surface 108 of piston 18 to drive the piston 18 between a first position and a second position. In this manner, reciprocating device 17 achieves a consistent pumping rate.

The operation of the present invention will now be described with reference to FIGS. 2 and 3. FIG. 2 shows valve member 10 in its first or "downstroke" position and piston 18 in its second or "upstroke" position. FIG. 3 shows valve member 10 in its second or "upstroke" position and piston 18 in its first or "downstroke" position.

With valve member 10 in its first position as shown in FIG. 2, control fluid supplied to the valve body 8 through port 20 communicates control pressure to annular chamber 142. Within annular chamber 142, the control fluid is isolated at the upper end of valve member 10 by seal 72 and at the lower end of valve member 10 by seal 74. The lower flared portion 113 of the valve member 10 engages a surface 109 formed by the difference in the diameter between the upper cylindrical portion 46 and the lower cylindrical portion 47 of the valve body 8 and prevents the further movement of valve member 10 downward in the direction of Arrow B. When valve member 10 is in its first position, slide valve portion 14 covers ports 24 and 26 and allows port 22 to communicate with annular chamber 142. Thus, control fluid is forced through port 22 and directed through a line 150 to a port 38 in reciprocating device 17 thereby communicating control fluid into lower piston chamber 146 to exert upward force on the lower surface 108 of piston 18. Piston 18 is thereby driven in the direction of Arrow A to its second position as shown in FIG. 2.

As piston 18 and thereby rod 12 reach the second position, transverse vent 28 aligns with port 30 and a recess chamber 140 is able to vent to low pressure through central longitudinal bore 42, central rod bore 44, transverse vent 28, lower chamber 148, port 30, a line 156, a tee fitting 200, a line 154 and a low pressure vessel 202. Low pressure vessel 202 represents atmospheric pressure or any pressure which is at least twenty percent (20%) lower than the pressure of the control fluid circulating within the valve body 8. The venting of recess chamber 140 creates a pressure differential between recess chamber 140 and annular chamber 142 across seal 72. This results in a force generated against the first pressure receiving surface 141 of valve member 10 to move valve member 10 upward in the direction of Arrow A toward its first position as shown in FIG. 2. Valve member 10 continues to move in the direction of Arrow A until an upper end surface 106 of valve member 10 engages a lower cap surface 105 of top cap 6. A second pressure receiving surface 107 of valve member 10 defines the recess chamber 140 between the valve member 10 and the lower cap surface 105 of top cap 6.

When valve member 10 reaches its second position, slide valve portion 14 moves upward to cover ports 22 and 24 and uncover port 26. In this position, ports 22 and 24 communicate via inner slot 69. Lower piston chamber 146, which was pressurized with the valve member 10 in its first position, vents to lower pressure at low pressure vessel 202 via port 38, line 150, port 22, inner slot 69, port 24, line 152, an adjustable backpressure valve 201, line 158, tee fitting 200 and line 154. Pressurized control fluid in annular chamber 142 communicates with upper piston chamber 144 of piston 18 through port 26, longitudinal passageway 34, port 32 and port 36. The differential pressure between the control fluid in upper piston chamber 144 and lower piston chamber 146 exerts a downward force on upper surface 110 of piston 18 forcing piston 18 downward in the direction of Arrow B to its first position as shown in FIG. 3. Piston 18 continues in its downward motion until lower surface 108 of piston 18 engages an upper reciprocating device surface 114 of reciprocating device 17. The rate of downward motion of piston 18 is controlled by the adjustment of the backpressure valve 201 to vary the rate that the control fluid acting on the lower surface 108 of piston 18 is depressurized and vented.

As piston 18 moves downward in the direction of Arrow B, transverse vent 28 in rod 12 passes through seal 76 and continues toward the end of its downward motion and passes through seal 82 positioned in the inner surface of bore 62 to preclude communication between upper piston chamber 144 and central bore 45. With valve member 10 in its second position, lower chamber 148 is continuously vented to low pressure via port 30, line 156, tee fitting 200, line 154 and low pressure vessel 202. Seal 74 prevents pressurized control fluid in annular chamber 142 from communicating with lower chamber 148.

When piston 18 returns to its first position, transverse vent 28 in rod 12 passes through seal 82 and communicates with upper piston chamber 144. Upper piston chamber 144 contains pressurized control fluid via port 26, longitudinal passageway 34, port 32 and port 36. Communication with upper piston chamber 144 through transverse vent 28 allows pressurized control fluid to fill central rod bore 44 and central longitudinal bore 42 and to act on the second pressure receiving surface 107 of valve member 10. In this manner, the control fluid in recess chamber 140 achieves a pressure equal to the control fluid in annular chamber 142. Because the second pressure receiving surface 107 of valve member 10 is of a greater surface area than the first pressure receiving surface 141, a downward force is generated forcing valve member 10 to move downward from its second position to its first position in the direction of Arrow B as shown in FIG. 2. The movement of valve member 10 from its second position to its first position causes slide valve portion 14 to move to cover ports 24 and 26 and allows port 22 to communicate with annular chamber 142. Valve member 10 is forced downward until the lower flared portion 113 of valve member 10 engages surface 109 of valve body 8.

With valve member 10 in its first position, upper piston chamber 144 vents to lower pressure through port 36, port 32, longitudinal passageway 34, port 26, inner slot 69, port 24, line 152, backpressure valve 201, line 158, tee fitting 200, line 154 and low pressure vessel 202. Also, pressurized control fluid in annular chamber 142 is communicated to lower piston chamber 146 through port 22, line 150 and port 38 in reciprocating device 17 to force piston 18 to its second position as shown in FIG. 2. The cycle is then repeated again and again. The rate of upward motion of piston 18 is controlled by the adjustment of the backpressure valve 201 to vary the rate that the control fluid acting on the upper surface 110 of piston 18 is depressurized and vented.

In this manner, the pilot control valve 5 of the present invention controls communication of control fluid to the piston 18 using pneumatic valve control and a single movable valve member, and the reciprocating device 17 coupled to the piston assembly 9 achieves a continuous and consistent pumping rate.

Although a preferred embodiment of the present invention has been described with reference to the foregoing detailed description and the accompanying drawings, it will be understood that the present invention is not limited to the preferred embodiment disclosed but includes modifications and equivalents without departing from the scope of the invention as claimed.

What is claimed as invention is:

1. A pump, comprising:

a valve body having an internal bore;

a piston coupled to the valve body having an upper surface and a lower surface, the piston positioned within a piston housing to define an upper piston chamber and a lower piston chamber;

a fluid inlet port in the valve body for communicating pressurized fluid to the valve body;

a first pressurized fluid conduit for communicating pressurized fluid from the valve body to the lower piston chamber to act on the lower surface of the piston;

a valve member slidable within the internal bore being selectively shiftable between first and second positions, the valve member having first and second pressure receiving surfaces selectively exposed to pressurized fluid from the fluid inlet port, the valve member in the first position defining a first pressurized chamber between the first pressure receiving surface of the valve member and the inner surface of the valve body and communicating pressurized fluid from the first pressurized chamber through the first pressurized fluid conduit to the lower piston chamber to act on the lower surface of the piston to move the piston from a first position to a second position;

a fluid exhaust conduit for communicating fluid from the valve body to a low pressure source;

venting means responsive to the piston in the second position for communicating fluid acting on the second pressure receiving surface of the valve member through the fluid exhaust conduit to the low pressure source, the pressurized fluid in the first pressurized chamber acting on the first pressure receiving surface of the valve member in response to the depressurization of the fluid acting on the second pressure receiving surface to move the valve member from the first position to the second position;

a second pressurized fluid conduit for communicating pressurized fluid from the valve body to the upper piston chamber to act on the upper surface of the piston;

the valve member in the second position defining a second pressurized chamber between the second pressure receiving surface of the valve member and a lower cap surface of a top cap of the valve body and communicating pressurized fluid to the upper piston chamber to act on the upper surface of the piston to move the piston from the second position to the first position;

the venting means responsive to the piston in the first position for communicating fluid acting on a lower end surface of the valve member through the fluid exhaust conduit to the low pressure source, the pressurized fluid in the second pressurized chamber acting on the second pressure receiving surface of the valve member to move the valve member from its second position to its first position.

2. The pump of claim 1 further comprising a second fluid exhaust conduit for communicating fluid from the valve body to the low pressure source, wherein the valve member further comprises a slide valve portion shiftable with the valve member between a first and second position, the slide valve portion in its first position precluding communication of pressurized fluid to the upper surface of the piston and communicating the fluid acting on the upper surface of the piston to the low source through the second fluid exhaust conduit to urge the piston toward its second position.

3. The pump of claim 2 further comprising a third fluid exhaust conduit for communicating fluid from the valve body to the low pressure source, wherein the slide valve portion in its second position precludes communication of pressurized fluid to the lower surface of the piston and communicates the fluid acting on the lower surface of the piston to the low pressure source through the third fluid exhaust conduit to urge the piston toward its first position.

4. The pump of claim 1 wherein the first pressure receiving surface of the valve member is formed by a flared portion of the valve member slidable within the internal bore of the valve body and communicating with pressurized fluid supplied through the fluid inlet port.

5. The pump of claim 4 wherein the second pressure receiving surface of the valve member has a greater surface area than the first pressure receiving surface of the valve member to generate a force when the valve member is in its second position that moves the valve member to its first position.

6. The pump of claim 1 wherein the valve member includes a central longitudinal bore, the central longitudinal bore aligned to receive a rod rigidly attached to the piston and the rod having a central rod bore in fluid communication with the central longitudinal bore of the valve member.

7. The pump of claim 6 wherein the venting means comprises a transverse vent at the lower end of the central rod bore that when the piston is in its second position communicates fluid in the central longitudinal bore of the valve member to the low pressure source, the pressurized fluid acting on the first pressure receiving surface of the valve member with the piston in its second position urging the valve member from its first position to its second position.

8. The pump of claim 7 wherein the transverse vent when the piston is in its first position communicates pressurized fluid from the fluid inlet port in the upper piston chamber through the central rod bore and through the central longitudinal bore of the valve member to act on the second pressure receiving surface of the valve member to urge the valve member from its second position to its first position.

9. The pump of claim 1 further comprising a reciprocating device coupled to the piston.

10. The pump of claim 9 wherein the reciprocating device achieves a pumping rate responsive to a backpressure valve coupled to the valve body that adjusts the depressurizing rate of the fluid acting on the upper and lower surfaces of the piston.

11. A pump, comprising:

a valve body having an internal bore;

a piston coupled to the valve body having an upper surface and a lower surface, the piston positioned within a piston housing to define an upper piston chamber and a lower piston chamber;

a fluid inlet port in the valve body for communicating pressurized fluid to the valve body;

a first pressurized fluid conduit for communicating pressurized fluid from the valve body to the lower piston chamber to act on the lower surface of the piston;

a valve member slidable within the internal bore being selectively shiftable between first and second positions, the valve member having first and second pressure receiving surfaces selectively exposed to pressurized fluid from the fluid inlet port, the valve member in the first position defining a first pressurized chamber between the first pressure receiving surface of the valve member and the inner surface of the valve body and communicating pressurized fluid from the first pressurized chamber through the first pressurized fluid conduit to the lower piston chamber to act on the lower surface of the piston to move the piston from a first position to a second position, the valve member in its first position precluding communication of pressurized fluid to the upper surface of the piston and communicating the fluid acting on the upper surface of the piston to a low pressure source to urge the piston toward its second position;

the piston having a rod rigidly attached thereto and aligned with a central longitudinal bore in the valve member, the rod having a central rod bore in fluid communication with the central longitudinal bore of the valve member;

a fluid exhaust conduit for communicating fluid from the valve body to the low pressure source;

a transverse vent in the central rod bore responsive to the piston in the second position for communicating fluid acting on the second pressure receiving surface of the valve member through the fluid exhaust conduit to the low pressure source, the pressurized fluid acting on the first pressure receiving surface of the valve member in response to the depressurization of the second pressure receiving surface to move the valve member from the first position to the second position;

a second pressurized fluid conduit for communicating pressurized fluid from the valve body to the upper piston chamber to act on the upper surface of the piston;

the valve member in the second position defining a second pressurized chamber between the second pressure receiving surface of the valve member and a lower cap surface of a top cap of the valve body and communicating pressurized fluid to the upper piston chamber to act on the upper surface of the piston to move the piston from the second position to the first position, the valve member in the second position precluding communication of pressurized fluid to the lower surface of the piston and communicating the fluid acting on the lower surface of the piston to the low pressure source to urge the piston toward its first position;

the transverse vent responsive to the piston in the first position for communicating fluid acting on a lower end surface of the valve member through the fluid exhaust conduit to the low pressure source, the pressurized fluid in the second pressurized chamber acting on the second pressure receiving surface of the valve member to move the valve member from its second position to its first position.

12. The pump of claim 11 further comprising a reciprocating device coupled to the piston.

13. The pump of claim 12 wherein the reciprocating device achieves a pumping rate responsive to a backpressure valve coupled to the valve body that adjusts the depressurizing rate of the fluid acting on the upper and lower surfaces of the piston.

* * * * *